United States Patent [19]

Hudson, Jr.

[11] Patent Number: 4,984,548

[45] Date of Patent: Jan. 15, 1991

[54] FUEL INJECTOR RETAINER CLIP

[75] Inventor: Sharon J. Hudson, Jr., Lambertville, Mich.

[73] Assignee: Sharon Manufacturing Company, Lambertville, Mich.

[21] Appl. No.: 438,858

[22] Filed: Nov. 20, 1989

[51] Int. Cl.[5] ..... F02M 55/02

[52] U.S. Cl. ..... 123/470; 123/468; 285/321

[58] Field of Search ..... 123/470, 471, 472, 456, 123/468, 469; 239/533.2, 550, 551, 600; 285/321, 323, 902

[56] References Cited

U.S. PATENT DOCUMENTS

| | | | |
|---|---|---|---|
| 2,125,477 | 5/1937 | Whitney | 285/902 |
| 3,389,923 | 6/1968 | Love | 285/321 |
| 4,294,215 | 10/1981 | Hans | 123/470 |
| 4,307,693 | 12/1981 | Glöckler | 123/470 |
| 4,474,160 | 10/1984 | Gartner | 123/470 |
| 4,475,516 | 10/1984 | Atkins | 123/470 |
| 4,570,602 | 2/1986 | Atkins | 123/468 |
| 4,823,754 | 4/1989 | Minamoto | 123/456 |

*Primary Examiner*—Carl Stuart Miller

*Attorney, Agent, or Firm*—Harold F. Mensing

[57] ABSTRACT

A retainer spring clip for holding an end of a fuel injector in an injector socket of a fuel rail. The retainer clip is attached securely to the socket nose end of an injector by a plurality of evenly spaced apart claw elements extending laterally from one side of a planar annular central disk section of the clip at the periphery thereof. An equal plurality of retention spring fingers extending laterally from the other side of the disk periphery are provided to givingly enter a fuel port aperture in a fuel rail injector socket. The claw elements and retention spring fingers have spring sections disposed in the plane of the disk. Additionally, the spring fingers have second spring sections extending laterally from the the first spring sections. Preferably, the claw elements are located at diametrically opposed peripheral positions from those of the spring fingers.

20 Claims, 1 Drawing Sheet

FUEL INJECTOR RETAINER CLIP

FIELD OF INVENTION

Generally speaking, this invention relates to a spring clip for releasably holding an end of an electromagnetic fuel injector in an injector socket of an automotive engine fuel supply rail. More specifically, it relates to a spring clip that can be securely attached to a socket nose end of an injector, inserted into an injector socket of the fuel rail and held there against accidental removal but capable of being removed intentionally whenever required.

BACKGROUND OF THE INVENTION

It is a common practice to preassemble the electromagnetic fuel injectors on the fuel rails of an internal combustion engine prior to the time the fuel rail is attached to the engine. A problem arose when the fuel injector-rail assembly was hung on a conveyor for transport to the engine assembly point. While being so conveyed the fuel injector-rail assembly was subjected to constant jarring and as a result some of the fuel injectors would fall out of their sockets along the way due to the fact that they were held in place only by the frictional engagement between the sockets and the "O" ring seals around the socket nose ends of the injectors. Injectors were damaged and lost along the way but an even greater problem was the costly production delays resulting from the missing fuel injectors at the final point of assembly.

Accordingly, it is a general object of this invention to solve the problem by providing a simple low cost spring clip which will effectively prevent accidental dislodgement of the fuel injectors from the fuel injector-rail assembly. It is another object to provide a spring clip which can be readily attached to the nose of the socket end of a fuel injector, inserted into an injector socket of a fuel rail and latched into place by spring fingers which protrude through a fuel port or outlet aperture in the head of the socket. It is still another object to provide such a spring clip which remains on the socket nose end of the injector when the injector is removed intentionally from the fuel rail.

SUMMARY OF THE INVENTION

The fuel injector retainer clip of this invention is adapted to securely clutch the nose of the socket end of an electromagnetic fuel injector and releasably latch the injector in an injector socket of an automotve engine fuel supply rail. The basic elements of the clip are a planar annular disk, a plurality of short inturned claw elements for gripping the socket nose end of an injector and a plurality of latch spring elements for projecting through a fuel port aperture in the head of the injector socket of the fuel rail. Both the claw elements and the latch spring elements extend laterally from the periphery of the annular disk, with the claw elements extending from one side and the latch spring elements extending from the other side.

The details and advantages of the invention will be understood best if the following description of a preferred embodiment is read with reference to the accompanying drawings.

DETAILED DESCRIPTION OF A PREFERRED EMBODIMENT

Figure 1:
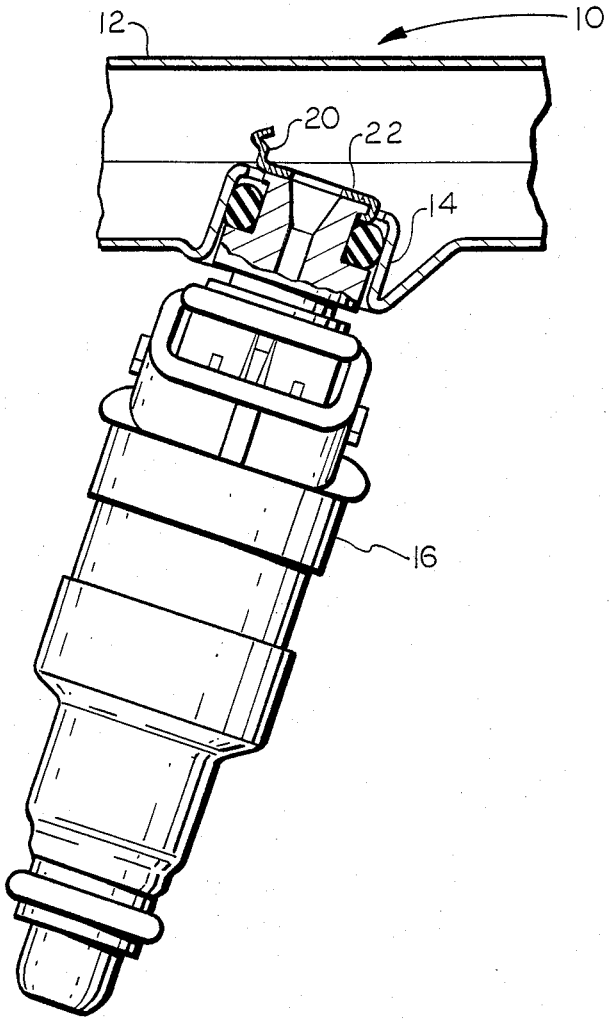
FIG. 1 is a partially sectioned side view, with parts broken away, of fuel injector-rail assembly including the fuel injector retention clip of this invention.

Referring to the drawings, it will be noted that the fuel injector-rail assembly 10 is comprised of a fuel supply rail 12, shown only in part, a fuel injector socket 14 recessed in the fuel rail, an electromagnetic fuel injector 16 and a fuel injector retention clip 20.

Figure 2:
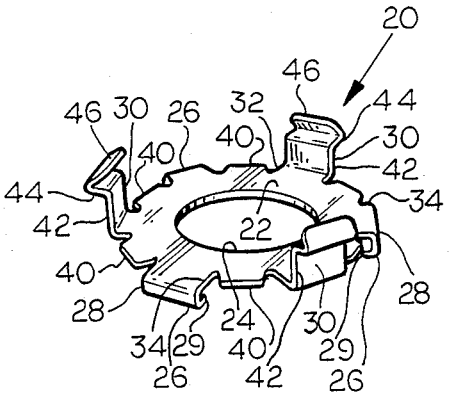
FIG. 2 is perspective view of the fuel injector retention clip by itself.

Retention clip 20 has planar annular central element or disk 22 with a notched periphery and a concentric center opening 24. Extending downwardly from the periphery of the disk as shown in FIGS. 1 and 2, are a plurality of inturned claw elements 26. The claw elements are equally spaced around the disk periphery and each of them has a relatively short section 28 disposed laterally with respect to the plane of the disk followed by an inturned hook section 29 at the terminal end of the claw element. Hook sections 29 secure the retainer clip to the injector by snapping over an annular flange located on the tip of the socket nose end of the injector adjacent to its "O" ring seal. Preferably, at least three claw elements 26 are provided.

Figure 3:
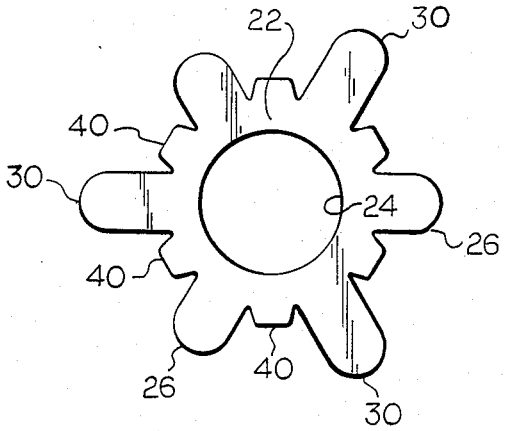
FIG. 3 is a plan view of the sheet metal blank from which the fuel injector retention clip is formed.

Similarly, a plurality of latch spring elements 30, preferably equal in number to the claw elements, extends laterally from the disk periphery. However, the latch spring elements extend laterally upward in a direction opposite from that of the claw elements, as illustrated in FIGS. 1 and 2 of the drawings . It is also preferred that the latch spring elements be disposed around the disk periphery at positions which are diametrically opposed to the claw element positions. FIG. 3 shows the relative position of these elements in the flat metal blank prior to forming. These latch spring elements 30 as well as the aforementioned claw elements 26 have relatively short spring sections 32 and 34, respectively, disposed in the plane of the annular central element 22. Spring sections 32 and 34 extend radially inward from the periphery of the central element to the inner extent of peripheral notches defined by the edge portions of each latch spring and claw element and the adjoining edges of radially disposed tabs 40 which are interspersed between each of said elements.

In addition to the relatively short spring sections 32, the latch spring elements 30 each has a laterally disposed relatively long second spring section 42 which provides greater flexibility in the latch spring elements than that of the comparable section 28 of the claw elements. Another advantage of the relatively long length of second spring section 42 is that it assures adequate clearance between the latching shoulder and the latching surface on the socket so latching can occur even when the injector is not bottomed out in the socket. Each latch spring element has a laterally disposed latching shoulder section 44 extending radially outward from its distal end which is followed by an inwardly inclined ramp section 46 at its terminus. The inclined ramp sections on the ends of the spring elements facilitate the insertion of the spring elements of the clip into and through a fuel port in the head of the fuel rail socket 14.

Once the ramp sections of the clip have been inserted beyond the port defining inner edge at the head of the injector socket, the spring elements snap outwardly causing the latching shoulder sections 44 to assume their latched positions.

It is apparent from the drawings and the above description that the relative sizes, shapes and positions of the various structural elements are effective in latching a fuel injector in its respective socket with sufficient resistance to prevent its accidental removal only. However, the resistance to removal is not so great as to prevent intentional removal, when required, through the use of moderate force. Also, the clutching force of the claw elements on the nose of the injector is sufficient to retain the clip securely on the nose of the injector through the removal process.

Although the invention has been described with respect to a single embodiment, it is to be understood that various minor modifications could be made without departing from the scope of the invention. For example, the fuel injector retainer clip of this invention could be used equally well on a fuel supply rail that has an external injector socket or cup of the type disclosed in U.S. Pat. No. 4,457,280 rather than a fuel supply rail with a recessed socket as shown and described herein. Likewise, the fuel injector retainer clip of this invention could be used in a fuel injector-rail assembly of the type wherein the output end of an electromagnetic fuel injector is socketed in the fuel rail rather than the type shown and described herein where the input end of the injector is the socketed end.

What is claimed is:

1. A fuel rail assembly comprising: a plurality of fuel injectors each having a socket nose end, a fuel rail with a plurality of apertured fuel injector sockets for containing each of said socket nose ends respectively, and a plurality of injector retainer spring members each clutching one of said nose ends of said injectors, said spring members each having a plurality spring fingers projecting through a fuel port aperture in its respective socket to the interior of said fuel rail.

2. A fuel rail assembly according to claim 1 wherein said retainer spring member has a planar annular midsection, a plurality of inturned claws extending laterally from one side of said midsection, and a plurality of spring fingers extending laterally in the opposite direction from the other side of said midsection.

3. A fuel rail assembly according to claim 2 wherein said claws and said spring fingers are disposed around the periphery of said midsection, and said claws are at diametrically opposite locations from said spring fingers.

4. A fuel rail assembly according to claim 2 wherein said claws and said spring fingers have spring sections disposed in the plane of said midsection.

5. A fuel rail assembly according to claim 4 wherein said midsection has coplanar tab sections extending to the periphery thereof between each of said spring sections, and wherein the sides of said tab sections together with adjacent sides of the coplanar spring sections define relief notches.

6. A fuel rail assembly according to claim 4 wherein said spring fingers each has a second spring section which extends lateral to the plane of said midsection.

7. A fuel rail assembly according to claim 6 wherein each of said spring fingers has a distal end, and said distal end has a laterally outwardly extending retainer shoulder section followed by an inwardly inclined ramp section at its terminus.

8. A fuel injector assembly comprising: a fuel injector with a socket nose end, a retainer spring clip for holding said nose end in an injector socket of a fuel rail, said retainer spring clip having a planar annular midsection, a plurality of inturned claws extending laterally from one side of said midsection, said claws jointly clutching said nose end, and a plurality of spring fingers extending laterally in the opposite direction from the other side of said midsection.

9. A fuel injector assembly according to claim 8 wherein said claws and said spring fingers are disposed around the periphery of said midsection, and said claws are at diametrically opposite locations from said spring fingers.

10. A fuel injector assembly according to claim 8 wherein said claws and said spring fingers have spring sections disposed in the plane of said midsection.

11. A fuel injector assembly according to claim 10 wherein said midsection has coplanar tab sections extending to the periphery thereof between each of said spring sections, and wherein the sides of said tab sections together with adjacent sides of the coplanar spring sections define relief notches.

12. A fuel injector assembly according to claim 10 wherein said spring fingers each has a second spring section which extends lateral to the plane of said midsection.

13. A fuel injector assembly according to claim 12 wherein each of said spring fingers has a distal end, and said distal end has a laterally outwardly extending retainer shoulder section followed by an inwardly inclined ramp section at its terminus.

14. A retainer spring clip for holding a socket nose end of a fuel injector in an injector socket of a fuel rail, said retainer clip comprising: a planar annular central section, a concentricaly disposed aperture in said central section, a plurality of claw elements for jointly clutching said input nose end, said claws extending laterally from the periphery of said central section on one side thereof, and an equal plurality of spring fingers extending laterally from said periphery on the other side thereof.

15. A retainer spring clip according to claim 14 wherein said claws and said spring fingers are equally spaced around the periphery of said midsection, and said claws are at diametrically opposite locations from said spring fingers.

16. A retainer spring clip according to claim 14 wherein said claws and said spring fingers have spring sections disposed in the plane of said midsection.

17. A retainer spring clip according to claim 15 wherein said midsection has coplanar tab sections extending to the periphery thereof between each of said spring sections, and wherein the sides of said tab sections together with adjacent sides of the coplanar spring sections define relief notches.

18. A retainer spring clip according to claim 16 wherein said spring fingers each has a second spring section which extends lateral to the plane of said midsection.

19. A retainer spring clip according to claim 18 wherein each of said spring fingers has a distal end, and said distal end has a laterally outwardly extending retainer shoulder section followed by an inwardly inclined ramp section at its terminus.

20. A retainer spring clip for holding a socket nose end of a fuel injector in an injector socket of a fuel rail, said retainer clip comprising: a planar annular central section, a concentricaly disposed aperture in said central section, a plurality of claw elements for jointly clutching said input nose end, said claws extending laterally from the periphery of said central section on one side thereof, and an equal plurality of spring fingers extending laterally from said periphery on the other side thereof, said claws and said spring fingers being disposed around the periphery of said midsection at diametrically opposite locations from each other, said claws and said spring fingers having spring sections disposed in the plane of said midsection, said midsection has coplanar tab sections extending to the periphery thereof between each of said spring sections, and wherein the sides of said tab sections together with adjacent sides of the coplanar spring sections define relief notches, said spring fingers each has a second spring section which extends lateral to the plane of said midsection, each of said spring sections has a distal end, and said distal end has a laterally outwardly extending retainer shoulder section followed by an inwardly inclined ramp section at its terminus.

* * * * *